US007665173B2

(12) United States Patent
Simonette et al.

(10) Patent No.: US 7,665,173 B2
(45) Date of Patent: Feb. 23, 2010

(54) AUTOMATED CLEANING SYSTEM FOR STRUCTURES

(76) Inventors: Dallas W. Simonette, HCR 33 Box 2962, 11575 W. Wigwam Ave., Las Vegas, NV (US) 89124; Michael R. Lange, 250 Carlson Pkwy., Apt. 124, Minnetonka, MN (US) 55305

( * ) Notice: Subject to any disclaimer, the term of this patent is extended or adjusted under 35 U.S.C. 154(b) by 515 days.

(21) Appl. No.: 10/982,505

(22) Filed: Nov. 5, 2004

(65) Prior Publication Data

US 2006/0096050 A1 May 11, 2006

(51) Int. Cl.
*A47L 1/02* (2006.01)

(52) U.S. Cl. ..... 15/50.3; 15/50.1; 15/103

(58) Field of Classification Search ..... 15/103, 15/50.1, 50.3, 52.1
See application file for complete search history.

(56) References Cited

U.S. PATENT DOCUMENTS

| | | | | |
|---|---|---|---|---|
| 3,108,301 | A * | 10/1963 | Jones | 15/77 |
| 3,292,193 | A | 12/1966 | Littin | |
| 3,298,052 | A * | 1/1967 | Wolfe | 15/302 |
| 3,344,454 | A | 10/1967 | Mikalson | 15/50.3 |
| 5,014,803 | A | 5/1991 | Urakami | 180/164 |
| 5,249,326 | A | 10/1993 | Jeffries | 15/50.1 |
| 5,465,446 | A | 11/1995 | Chang | |
| 5,707,455 | A | 1/1998 | Tomita | 134/18 |
| 5,890,250 | A | 4/1999 | Lange et al. | 15/50.3 |
| 5,901,720 | A | 5/1999 | Lange | |
| RE36,649 | E * | 4/2000 | Jefferies et al. | 15/50.1 |
| 6,158,678 | A | 12/2000 | Lange | |
| 6,550,090 | B1 | 4/2003 | Jesadanont et al. | |
| 6,601,256 | B2 * | 8/2003 | Lee | 15/50.3 |
| 6,802,098 | B2 * | 10/2004 | Geyer et al. | 15/52.1 |

FOREIGN PATENT DOCUMENTS

| | | |
|---|---|---|
| EP | 0271454 | 6/1988 |

* cited by examiner

*Primary Examiner*—Shay L Karls
(74) *Attorney, Agent, or Firm*—Richard John Bartz

(57) ABSTRACT

A washing system for an elevated surface has a) a housing having a liquid application cleaning system therein; b) a support element that supports and elevates the washing system; c) a rigid member extending from a surface of the housing that faces away from a surface to be cleaned so that the cable, when supporting the cleaning system against the surface to be cleaned and connected to the housing at a connection point, exerts a rotational force on the cleaning system in relation to the fixed fulcrum at the roof top; and d) weights provided at a distance and direction from the connection point fulcrum to at least in part counterbalance the rotational force.

21 Claims, 13 Drawing Sheets

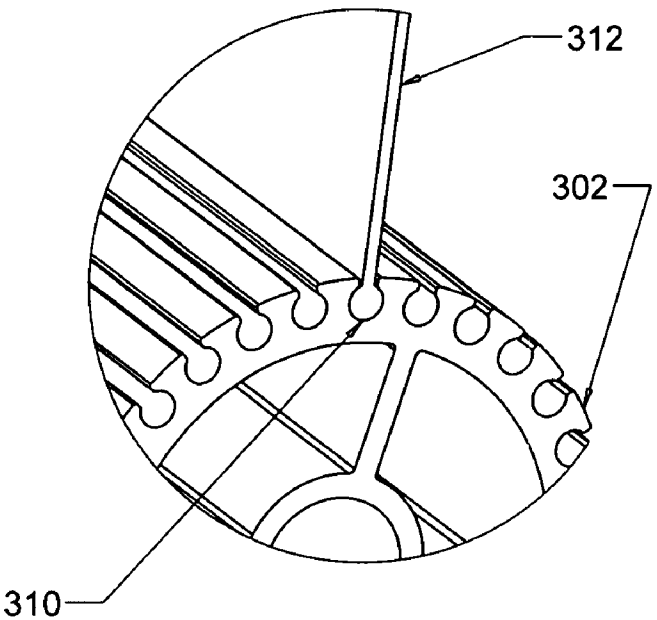
FIG.4b
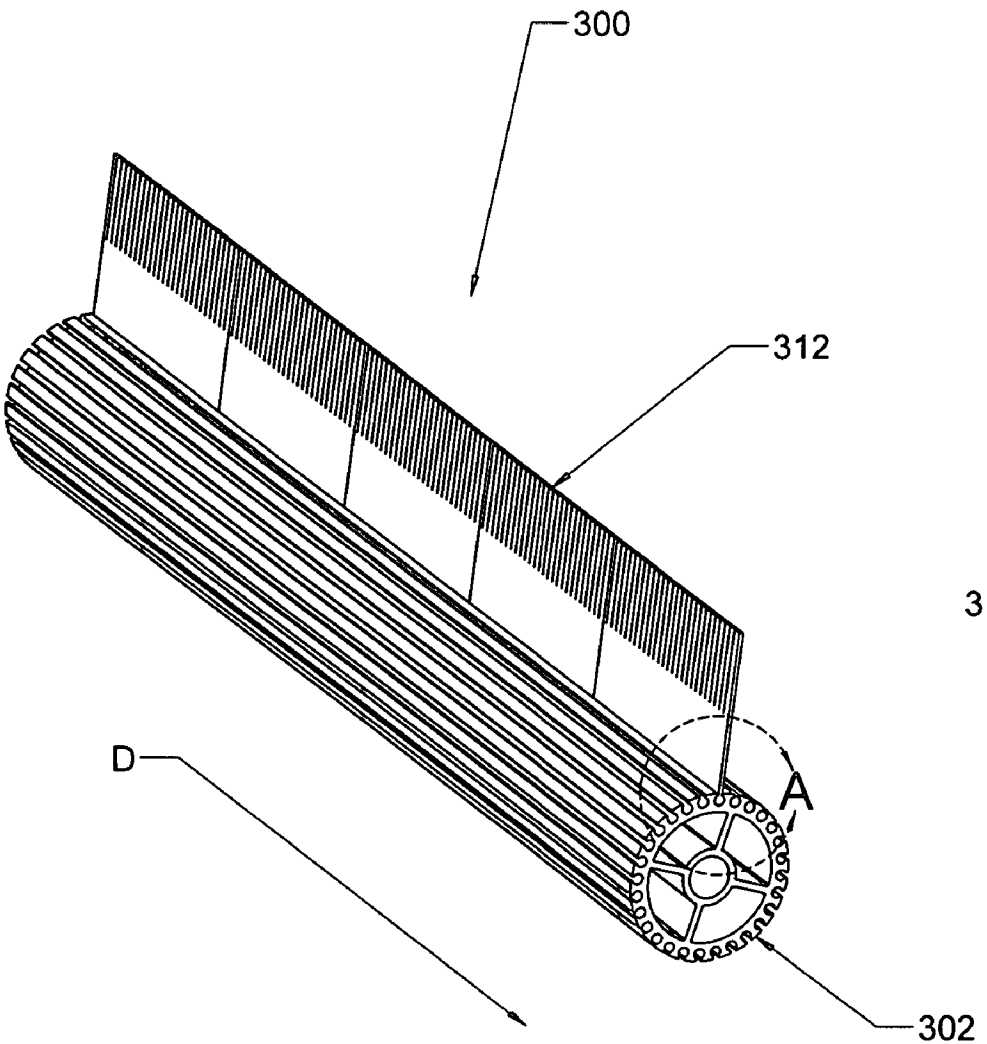

AUTOMATED CLEANING SYSTEM FOR STRUCTURES

BACKGROUND OF THE INVENTION

1. Field of the Invention

The present invention relates to cleaning systems, particularly liquid application cleaning systems, automated cleaning systems, and cleaning systems for structures, such as buildings.

2. Background of the Art

Building structures, particularly tall urban buildings, are typically washed manually. A scaffolding structure is usually suspended from the top of the building to be washed. The scaffolding can be raised or lowered so that a person standing on the scaffolding can wash the windows and exterior surfaces of the building by hand. After a vertical section of the building is washed, the scaffolding is repositioned laterally so that the next adjacent vertical section of the building may be cleaned. This procedure may be repeated until the entire building has been washed. Cleaning windows using scaffolding is extremely time consuming. In an effort to reduce time and cost, therefore being more competitive in the industry, window washers tie a climbing rope to the roof anchors provided for the scaffolding and throw the rope over the side of the building. Then they attach a bosons chair to the rope and a climber's harness to themselves with repelling hardware. The man goes over the side of the building with his tools and water/soap bucket and cleans 6-8 of horizontal glass width per story. Then repels down to the next level and repeats until that drop is complete.

Manual washing of buildings has proven to be quite dangerous, especially with respect to tall skyscrapers. Typical wind and air drafts surrounding a building can exert a significant aerodynamic force upon a scaffolding structure or window cleaning laborer, causing them to swing out and away from the building, and placing persons standing on that scaffolding or suspended on a rope in peril. Injuries from manual window washing operations are common, and have caused insurance rates to soar. Typically, the cost of insuring a window washing operation can reach 40% of the labor costs. Furthermore, the manual washing of building exteriors is slow and labor-intensive.

Effectively removing mineral deposits from building windows has been a problem which has long plagued the industry. Normal water supplies conventionally used for wash water contain some amount of dissolved solids, including calcium, magnesium, and sodium in the form of bicarbonates, carbonates, chlorides, or sulfates. Regardless of the type or form of the dissolved solids, when a water droplet is allowed to dry on a surface, the solids typically remain as deposits on the surface.

When washing a window, a single water drop left on the surface will typically contain between 300 and 1000 parts per million of dissolved solids, in addition to varying amounts of suspended solids removed from the surface by washing. When water drops evaporate, mineral deposits are left in "spots". Compounding the spotting problem is the fact that when a window is being cleaned in sunlight, the surface of the window can be elevated to as much as 120.degree. F. Wash water in such circumstances evaporates quickly and can be seen to "steam" off of the window. Heavy and ultimately damaging mineral deposits can result.

Surface active agents (i.e. cleaning agents), such as polyphosphate and organic detergents, serve to spread adhering water drops over a wider area, making water spotting less noticeable. However, the effect is only cosmetic as the accumulation of hard mineral deposits as a whole is unaffected.

Although various automatic window washing devices have been described in the art (see, for example, U.S. Pat. Nos. 3,344,454 and 3,298,052), the inventor is not aware of any such devices which have proven to be practical or accepted in use. Such devices typically employ mechanical techniques to scrub the surface and to remove residual water. These cleaners suffer from a combination of several problems. First, many require some form of tracking (e.g., vertical mullions) on the building facade to guide the device up and down and maintain cleaning contact with the surface. Second, many include elaborate mechanical water collection and liquid removal apparatus, adding weight and expense to the overall device. Finally, since it is difficult to completely remove all of the wash water from the surfaces, and since all devices known to the inventor use common tap water (with or without detergents) as the washing medium, they tend to clean ineffectively, leaving mineral deposits from the tap water itself.

It is desirable to use unmanned, self-propelled vehicles such as robots to perform a variety of functions that would be difficult or dangerous for a person to perform. For example many people frequently use robots to retrieve or dispose an explosive device or inspect or work in an environment that could kill or injure a person. People also frequently use robots to inspect or work in locations that typically are hard to access or are inaccessible by a person such as inspecting a pipeline.

Unfortunately, because robots typically propel themselves to a work site, use of most conventional unmanned, self-propelled vehicles is typically significantly limited by the ability of the robot to propel itself over a surface. For example, surfaces that include compound curves or three dimensional curves, abrupt inclinations or declinations, steps or gaps can cause conventional robots to become significantly less stable, i.e., more likely to lose their preferred orientation relative to the surface, as they traverse the surface or turn on it. In addition, surfaces that are slippery can cause conventional robots to easily lose a significant portion, if not all, of their traction to the surface. If either happens while traversing an incline or inverted surface such as a ceiling, such a loss of traction could cause the robot to fall. Such a fall could seriously damage the robot, its payload if it has any, or the surface or other components of the structure the robot is traversing.

Another problem with conventional robots is they tend to scrub the surface as they traverse and turn on it. This can cause undesirable scratches on the surface. For example, the exterior surface of the glass may have a reflective or solar coating or film that is more easily scratches than the glass.

Yet another problem with conventional robots is they tend to bounce or jerk as they propel themselves across a surface. This can be a significant problem during use on glass surfaces.

U.S. Pat. No. 5,249,326 discloses a washing system comprising a cleaning device for cleaning exterior surfaces of buildings, means for suspending the cleaning device in contact with the building surface to be cleaned, and means for causing the washing unit to traverse the building surface to be cleaned. Means for restraining the cleaning device against the building surface to be cleaned are provided, said restraining means including a restraining cable having a free weight attached thereto, means for attaching the restraining cable to the building at a point above the cleaning device, and a member for attaching the restraining cable to the building at a point below the cleaning device, the member being mounted on a suction cup adapted to engage the building. In use, the restraining cable is attached to the building at a point above the cleaning device, then passes over the cleaning device, and is threaded through the member below the cleaning device, such that the free weight hangs below the member and exerts a downward force on the cable, and the cable thereby restrains the cleaning device against the building surface to be cleaned. Preferably, the member connected to the suction cup comprises a pulley. Alternatively, it may be a loop, a U-shaped piece, or any other structure having a bore or passage through which the restraining cable can pass.

U.S. Pat. No. 5,890,250 describes a robotic apparatus for applying fluids to the exterior surfaces of vertical, nearly vertical, or sloped surfaces with minimum human supervision. The robotic apparatus is designed to apply fluids to surfaces which may include obstacles such as window frames or gaps created by window seams, which the present invention is designed to traverse. The robotic apparatus includes housing, a drive assembly, a sliding vacuum assembly, a fluid spray assembly, and sensor and control systems. The drive assembly includes drive chains, cables, ropes or the like that are connected at one end to a carriage positioned on the top of the structure and to a stabilizing member or members at the other end.

U.S. Pat. No. 5,707,455 describes an automated cleaning method is provided for an exterior wall of a building. Elongated, water-tight or electrically-insulating hollow members are accommodated within upper and lower sash rails constructing said exterior wall so that said hollow members continuously extend in horizontal directions, respectively. An electrical conductor extends in one of the hollow members. The other hollow member forms a drainage system. A cleaning apparatus main unit is arranged so that said cleaning apparatus main unit is supplied with electric power through said conductor to permit self-traveling in a horizontal direction along said exterior wall and is also supplied with washing water from said drainage system to permit cleaning of a surface of said exterior wall. The washing water is drained into said drainage subsequent to the cleaning by said cleaning apparatus main unit. The washing water can be recirculated for reuse.

U.S. Pat. No. 5,014,803 describes a device, including a window cleaning device, comprising a main body, a motor and drive wheels mounted on the main body, a partitioning member mounted on the main body and defining a pressure reduction space in cooperation with the main body and a wall surface, and a vacuum pump for reducing the pressure of the pressure reduction space. The device can suction-adhere to the wall surface by the pressure of an ambient fluid acting on the main body owing to the difference in fluid pressure between the inside and outside of the pressure reduction space and move along the wall surface by the action of the moving member. The partitioning member has an outside wall portion extending from its one end to a contacting portion contacting the wall surface and an inside wall portion extending from the contacting portion to its other end. A stretchable and contractible portion is provided in at least one of the outside and inside wall portions, and the contacting portion moves toward and away from the wall surface by the stretching and contracting of the stretchable and contractible portion.

SUMMARY OF THE INVENTION

A system enables cleaning of relatively flat surfaces without the use of personnel at the specific site of cleaning. The system can be fully automated, with programming set to enable the system to clean an entire surface or structure (e.g., an office building or hotel). The system may also be operated in full manual or semi automated configuration by a single operator safely positioned on top of the building roof. A first motor is provided on a moving carriage that contains the washing instrumentality that may both drive washing elements and provide counterweight that keeps the carriage in firm contact with the surface. A separate second motor may move a roof support carriage horizontally with respect to the surface, while a third motor controls vertical movement of the washing carriage. The third motor may be mounted on the roof support carriage or on the washing carriage.

BRIEF DESCRIPTION OF THE FIGURES

FIG. 4*b* shows a perspective view and a cutaway view of a support body having multiple vanes of flexible force applying material.

DETAILED DESCRIPTION OF THE INVENTION

Figure 1:
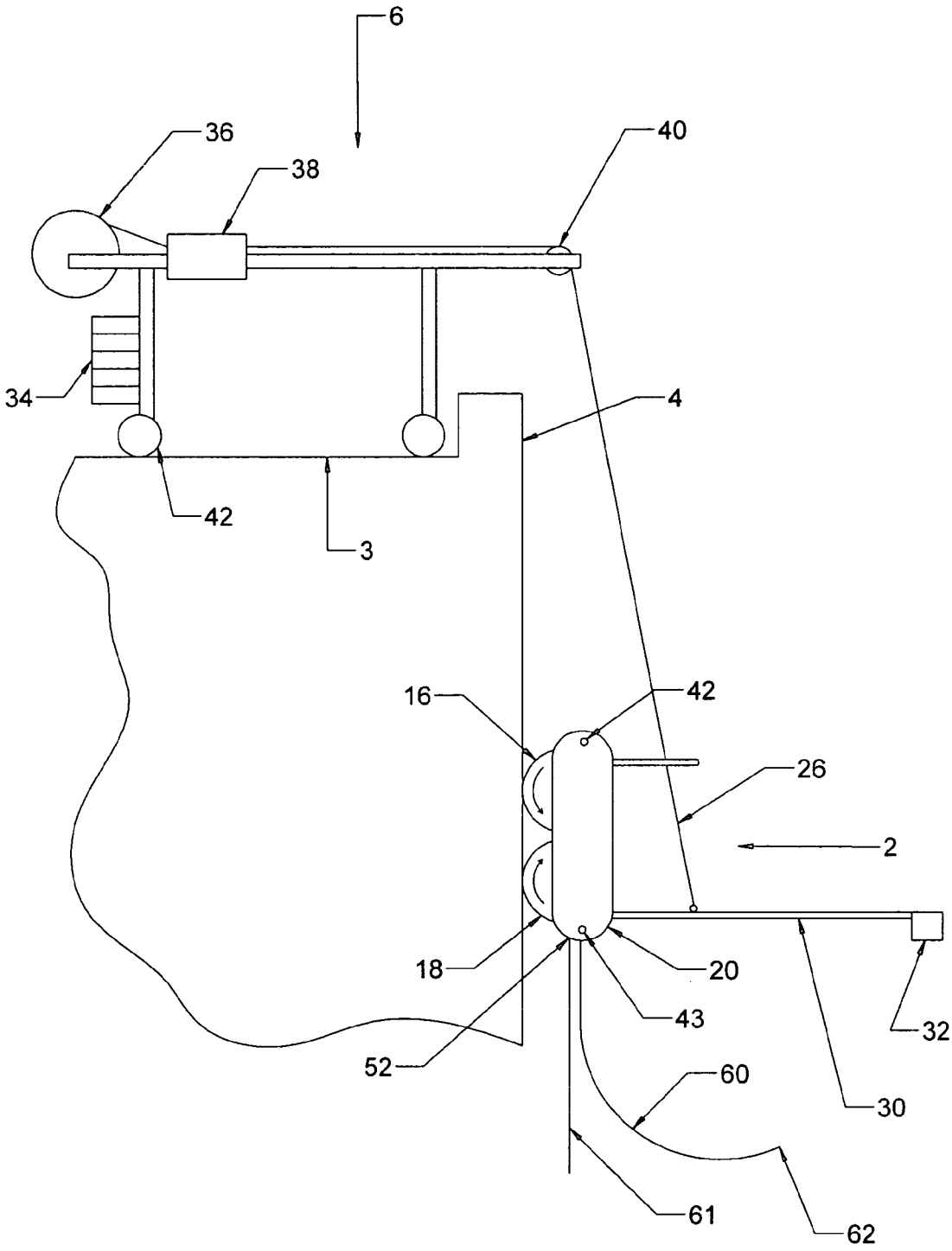
FIG. 1 shows a schematic side view of a cleaning apparatus alongside a building according to descriptions of technology provided herein.

A cleaning system according to technology described herein may comprise at least two distinct components that interact to provide a complete cleaning system for the cleaning of relatively flat surfaces, such as the exterior vertical surfaces of office buildings, hotels, hospitals and other multistory structures with, by way of non-limiting examples, up to 8 or 10 inches of sharp vertical deviation from flatness between areas of the surfaces (e.g., vertical elevation of panels separating window areas). The system exhibits stability against winds and provides high quality cleaning ability on window surfaces without the use of personnel at the immediate cleaning areas.

A non-limiting general description of the cleaning system described herein may be considered as a washing system for elevated surfaces comprising: a) a housing having a liquid application cleaning system therein; b) a support element that supports and elevates the washing system; c) a rigid member extending from a surface of the housing that faces away from a surface to be cleaned so that the cable, when supporting the cleaning system against the surface to be cleaned and connected to the housing at a connection point, exerts a rotational force on the cleaning system in respect to the fulcrum point at the roof rig connection point; and d) weights provided at a distance and direction from the connection point to at least in part counterbalance the rotational force around the connection point on the extended member. The system may have the support element comprises a) a cable, b) hose, c) rope, or d) two or more of a rope, cable and hose. The system of may have the support element as an electrical cable. The system may have the connecting point and the weight located on the rigid member. The system may have the connecting point on the housing or the rigid member, and a pulley might carry the support cable to the connecting point, and a securing cable attaches the rigid member to the pulley. The cleaning system may comprise at least one roller that contacts the surface to be cleaned, or at least two rollers that contact the surface to be cleaned.

The two distinct and interacting components of the system comprise a first component of a parapet wall-gripping support or a rooftop rolling support that controls movement along a direction relatively horizontal to a surface to be cleaned while supporting and possibly controlling the vertical movement of a second component cleaning carriage that moves horizontally and vertically along the surface to be cleaned. Both types of the first component comprises both a rotationally stabilizing support system that prevents the first component from being pulled off the building and a wheel-based system that allows the first component to be easily moved in a direction along a roof edge and relatively horizontal to the surface to be cleaned. The second component comprises a carriage that can move both horizontally and vertically with respect to the surface to be cleaned and contains a cleaning system, counterbalancing weight system and may have a motor that may control both vertical movement and provide stabilizing mass to the second component to assist in stabilizing the second component contact with the surface to be cleaned.

The cleaning system for the surfaces is generally particularly designed for glass or coated glass (e.g., surfaces having abrasion-resistant coatings, light filtering coatings, enhanced cleanable surfaces, etc.) surfaces, but any structure having a relatively flat surface can be cleaned by the present technology. The actual cleaning is done by the application of a cleaning liquid to the surface with sufficient forces involved in the time frame immediate with the liquid application or subsequent to the application to assist in removal of dirt, film, particles, soil age, caked material, deposits, and the like from the surface. Although many systems use jet spray or hand application, especially in conjunction with personnel at the cleaning site (e.g., handling applicators, squeegees, brushes, hoses, buckets, sprays, etc., as opposed to merely being on the roof directing the equipment), jet spray application is less preferred because of its tendency under Newton's Second Law of Motion to push the cleaning apparatus from the wall and make it more susceptible to displacement by ambient air currents and wind. Jet spray application, even with the assistance of heat and chemical, fails to clean the film coating on the surface being cleaned. A preferred application system comprises brush application, sponge application, strip application, foam finger application, sheet application and the like, where physical elements exert a physical force such as a rubbing action against the surface to be cleaned in the present of a cleaning liquid (which may be water, alone). The second component therefore usually may comprise a carriage for support of a motor, liquid delivery system, physical contact system for applying force against the surface to be cleaned while the surface is in contact with the liquid, and a counterbalancing weight system assisting in keeping the physical contact system in a cleaning orientation with respect to the surface to be cleaned. Each of these elements will be discussed in greater detail in a review of the Figures of the described technology.

In reviewing the following figures, and especially the schematics, the proportions shown in the figures, and the specific position of elements is not intended to be limiting with respect to the structures disclosed or the scope of claims appended hereto, but rather are intended to be instructive of a generic concept that is enabled by the shown examples.

FIG. 1 shows a schematic side view of a cleaning apparatus or system 2 alongside a building 4 according to descriptions of technology provided herein. The cleaning system 2 has a first component 6 which is positioned on a roof top 3. The first component 6 may comprise various elements that accomplish the requirements of the specific elements described in the following disclosure. In FIG. 1 is shown a rolling carriage element which has lockable position castor wheels 42 which allows for transporting the washing unit 20 to the edge of the building and then providing the horizontal movement during the wash cycle. Counter weights 34 of sufficient weight to provide support for suspension of the washing element 20 over the side of the building. A grip style winch 38 powers the movement of cable 26 to provide the vertical operation for the washing element 20. Cable winder 36 stores the slack cable for use by winch 38. The second component may also comprise a first cable 26 or line support system 40, here shown as a pulley, to allow extended movement of a winch that operates on a cable or line 26 that supports the carriage 20. Lengthening of available cable 26 allows for vertical movement of the carriage 20 with respect to the surface 4 to be cleaned. The carriage 20 may also comprise as part of the counterbalancing weight system a pole or rod 30 (here shown extending directly from general connection from the carriage 20, which ends with a counterbalancing weight 32 To provide a inward force for stabilization and washing.

The preferred cleaning action of the cleaning elements 16 and 18 in the carriage 20 may be generally described as the provision of liquid to the wall 4 (here shown with internal liquid applicators 42 and 43), and the application of forces against the wall 4 in the presence of delivered liquid, here the forces shown to be delivered by rotating elements 16, 18 within the carriage 20. The cleaning elements 16, 18 (which are described in greater detail later) preferably rotate in a predetermined manner. One preferred method is to have (from the perspective shown) applicator 18 rotate clockwise b and to have applicator 16 rotate counterclockwise c. In this manner or opposed rotation, cleaning action is performed on all horizontal and vertical surfaces that are perpendicular to the vertical face of the building (i.e. window frames) with a single pass of the cleaning carriage. A second feature is that liquid is moved rearwardly where it maybe easily collected if desired. Liquid may be carried within the carriage for reapplication or collection for controlled disposal as may be required by local EPA authorities. More preferably a hose system 60 carries liquid from an upper end 62 attached to a liquid supply system (e.g., a deionized water tank, not shown) to the carriage 20 and applicators 42 and 43).

In FIG. 1, a liquid capture area 52 in the lower portion of housing 20 can be provided to collect the dirty water via drain hose 61 and send it to collection tank on the ground or roof top for proper disposal as may be required by the EPA.

Figure 2:
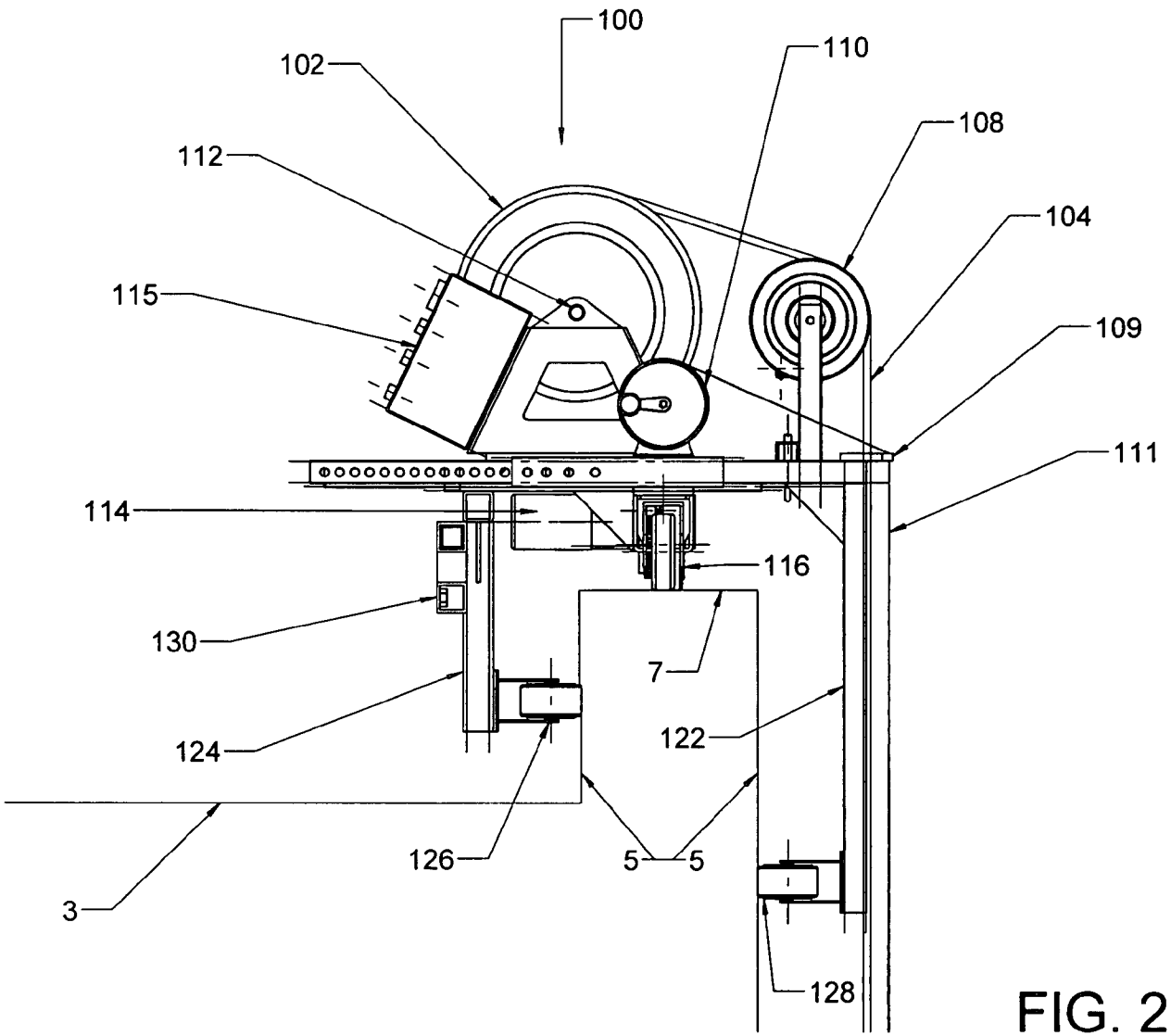
FIG. 2 shows a side view of a carriage support and traveling mechanism used on a parapet wall to carry a cleaning system.

FIG. 2 shows a more limited side view of sections of the first component 100 positioned on the top lip 7 of parapet wall 5 adjoining the building roof 3. A motorized hose reel 102 (which may also perform with strong hose 104 construction as part of the second component [not shown] support system and counterbalancing system) provides the hose 104 and pulley 108 to direct the hose 104 towards the second component (not shown). A guide line storage winch 110 directs a support cable 111 through cable guide 109 towards the second component (not shown). There is a water supply input 112 into the hose reel 102, a motor such as a servo motor 114 for indexing or moving the first component 100 (and therefore also the second component) relatively horizontally with respect to the interior and exterior surfaces 5 of the top lip 7. Movement of the first component 100 is facilitated by wheels 116, 126 and 128 which contact various areas of the parapet wall 5. The first component is restrained and secured against unwanted movement away from the wall by a support system including interior wall support 124 (with wheel 126), exterior wall support 122 (with wheel 128) and the support provided by servo wheel 116. The servo motor 114 powers the carriage (relatively horizontal with respect to the surface to be cleaned) movement of the first component and the second component during use. That servo motor 114 may be directed by a processor, housed in control box 115, having a program therein that assists in the proper movement of the first component.

There may be sensors (e.g., 130) on the first component that detect the end of the building that provide a signal to the processor in control box 115, that the end of the building has been reached, so that the direction of the servo motor operation will timely reverse and move the first component (and the second component) in an alternate direction from previous travel to traverse the relatively vertical face of the wall or structure being cleaned). The processor may also be preprogrammed by an operator according to specific dimensions measured by the operator and/or the first component (by moving it an entire length of an edge and recording that dimension), and that dimension used to determine a reverse point in the operation of the cleaning system. The processor may also be programmed to control the motor that provides the vertical movement of the second component for the height of the building or the height of the surfaces to be washed (accounting for an entrance way height that is not to be cleaned).

Figure 3:
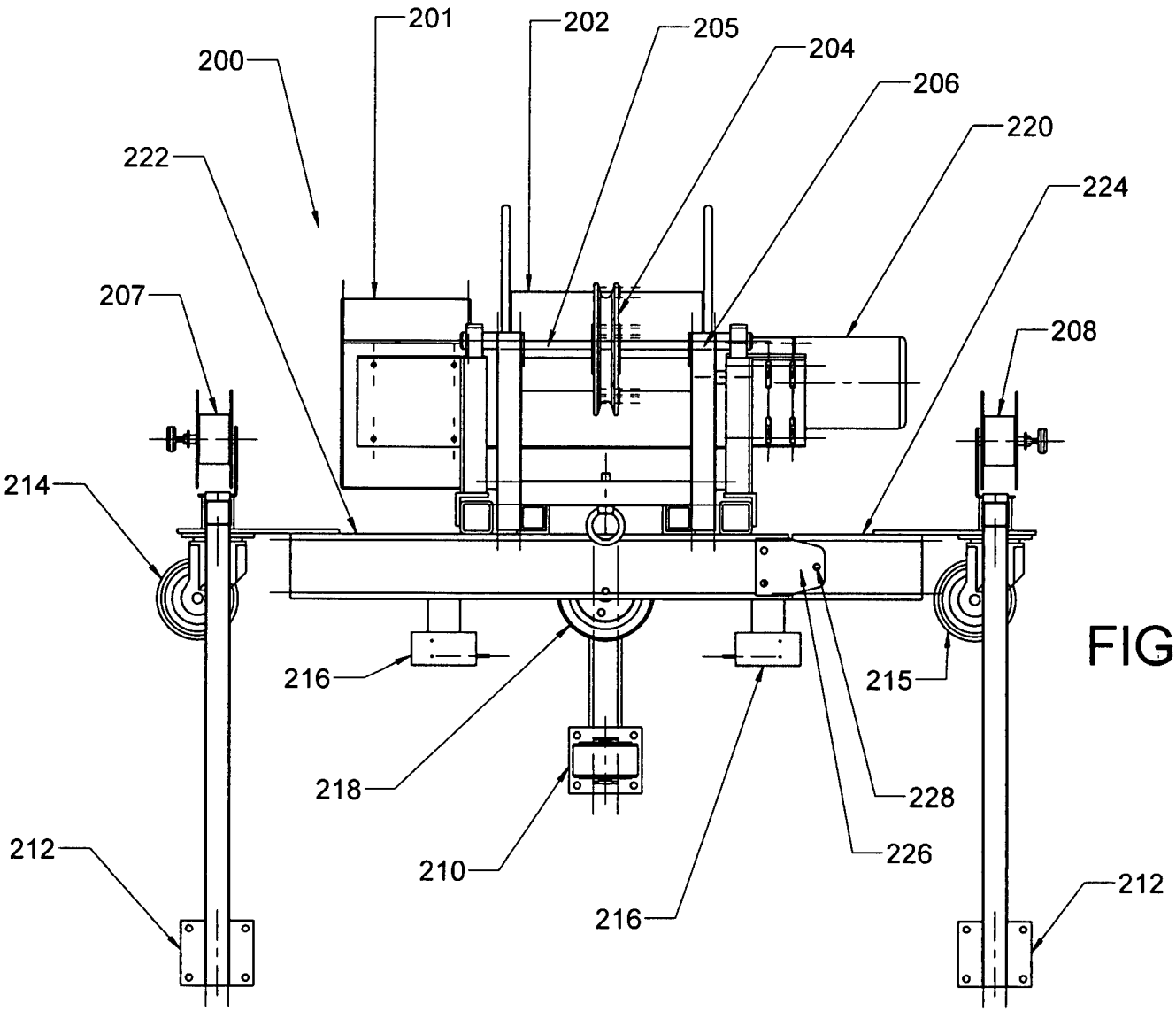
FIG. 3 shows a back view of a carriage support and traveling mechanism used on a parapet wall to carry a cleaning system.

FIG. 3 shows a front view of an embodiment of a first component 200 construction having a liquid supply hose dispenser 202 with a pulley 204 for guiding the supply hose (not shown) over the side of the building. Pulley 204 floats freely on shaft 205 and is constrained and supported by frame 206. This allows the hose to wind and unwind in layers on hose dispenser 202 for efficient operation and maximum storage capacity. There are two other dispensers/pulleys 207 and 208 that may provide feed of cable and lines to the second component (not shown). Interior wall braces 210 and exterior wall braces 212 are shown, along with transport wheels 214, 215 and 218 that support the first component 200 and rotate along a top flat area of the parapet wall (not shown). A motor 220 is shown that may drive the hose dispenser 202 and/or move wheels (such as 218) for their apparent functions. A system is provided to maintain sufficient force to allow traction for drive wheel 218, while compensating for varying elevations of the top of the parapet wall surfaces. The drive wheel 218 and support wheel 214 are rigidly mounted to the main support frame 222. Attached to swing arm frame 224 is support wheel 215. Swing arm 224 is connected to the main support frame 222 by pivot bolt 228 through brackets 226, which are rigidly mounted to main support frame 222. There is a control box 201 into which programming or operator input may be provided to control automatic movements and analysis of sensing by the system. The main structural support is shown as a main frame 222 and a swing arm frame 224, connected to the main frame 222 through a pivot bolt 228. There may be two opposed (each facing outwardly) photoswitch housings 216 that sense an approach to an edge or wall, sending a signal (by wire or wireless) to the control box 201, causing the movement of the first component 200 to stop or to stop and reverse.

An alternative traction and support system for components 200 may be comprised of a support wheel on one end of the main frame and a traction wheel at the other end.

Figure 4A:
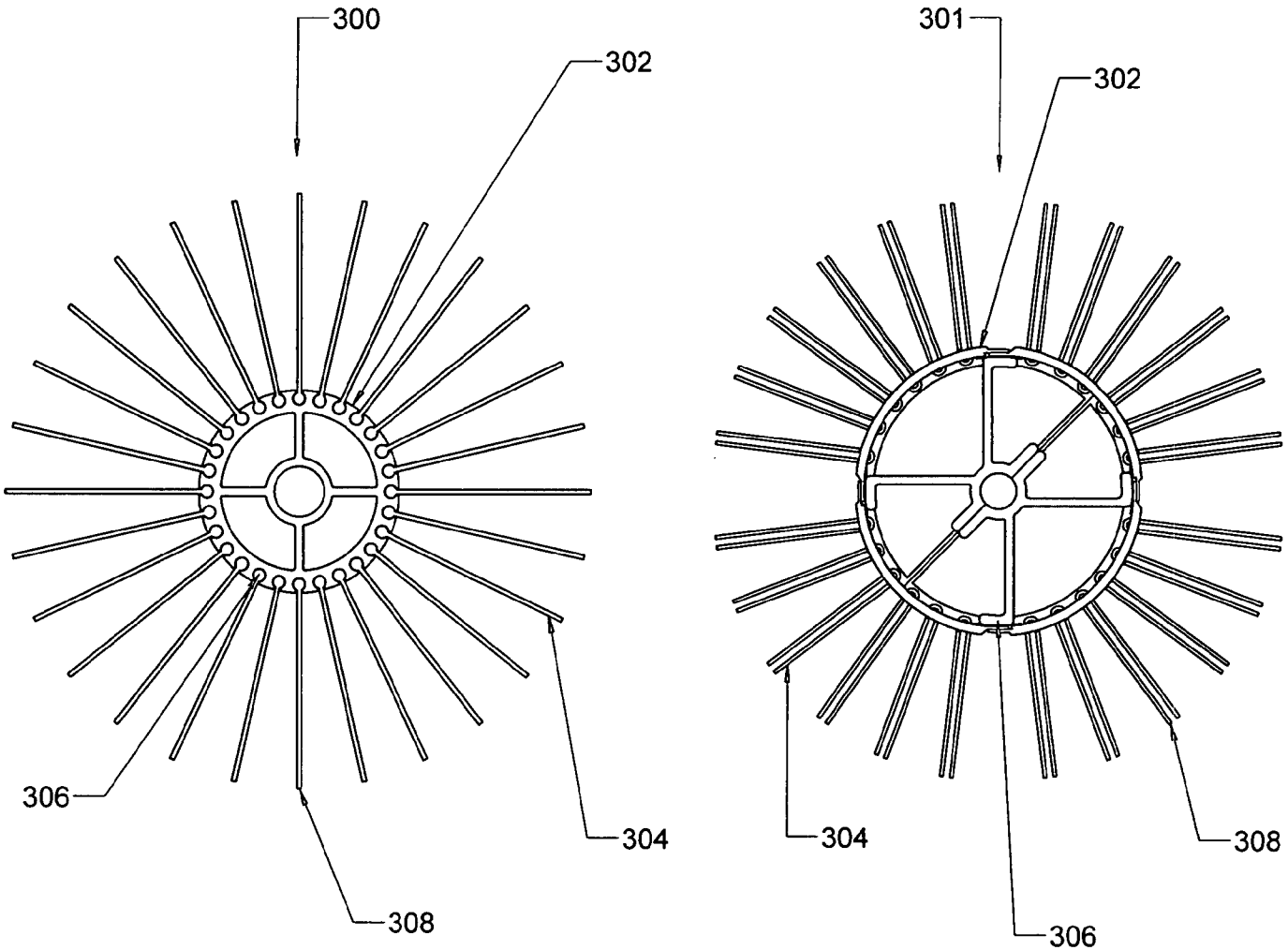
FIG. 4*a* shows two different side views of different possible force providing assemblies for the second component comprising a support body having multiple vanes of flexible force applying material.

FIG. 4*a* shows an optional force providing assembly 300 for use as one embodiment of the second component comprising a support body 302 having multiple vanes 304 of flexible force applying material. One method of effecting a locking element 306 is shown that secures the vanes into the support body 302. An optional non-abrasive weighted tip 308 is also shown on a vane 304 to reduce wear of the vanes 304. FIG. 4*b* shows a perspective image of the assembly 300 with a single groove 310 shown in the support body 302, the single groove and a single shadow image of a single vane 312 shown for simplicity. When the vane 312 becomes worn over time, the vane 312 may be slid along direction D (in FIG. 4*b*) out of the groove 310 for easy replacement, the ball locking mechanism 306 retaining the vane 312 within the groove during rotation of the support body 302 in the second component (not shown).

The optional format of assemblies 300 may vary in size and have diameters between about 20 and 90 centimeters, with the vanes being about 8 to 40 centimeters in length. The composition of the vanes is not critical, but some materials are more desirable than others. For example, vanes of polymeric filament or brushes provide good material removal, but can be too abrasive on glass surfaces. Cloth or fabric materials are less abrasive, but tend to be too expensive and can wear out quickly. Porous or closed cell foam strips (as are used in some car washing systems) have been found to be a good balance, with relatively low cost and low abrasion resistance, yet a reasonable wear life.

FIG. 4*a* shows two alternative different types of a force providing embodiment of a typical assembly 300 for the second component comprising a support body 302 having multiple vanes of flexible force applying material 304. Section A in FIG. 4*b* is used for the detail section showing an individual vane 312 engaged within a groove 310 of the support body 302 and to provide additional force created by the centrifugal force from the rotating action of support body 302.

FIG. 4*b* shows a perspective image of the assembly 300 with a typical groove 310 shown in the support body 302. When the vane 312 becomes worn over time, the vane 312 may be slid along direction D out of the groove 310 for easy replacement. Vanes 312 are retained in grooves 310 by an interference between the two diameters.

Figure 4C:
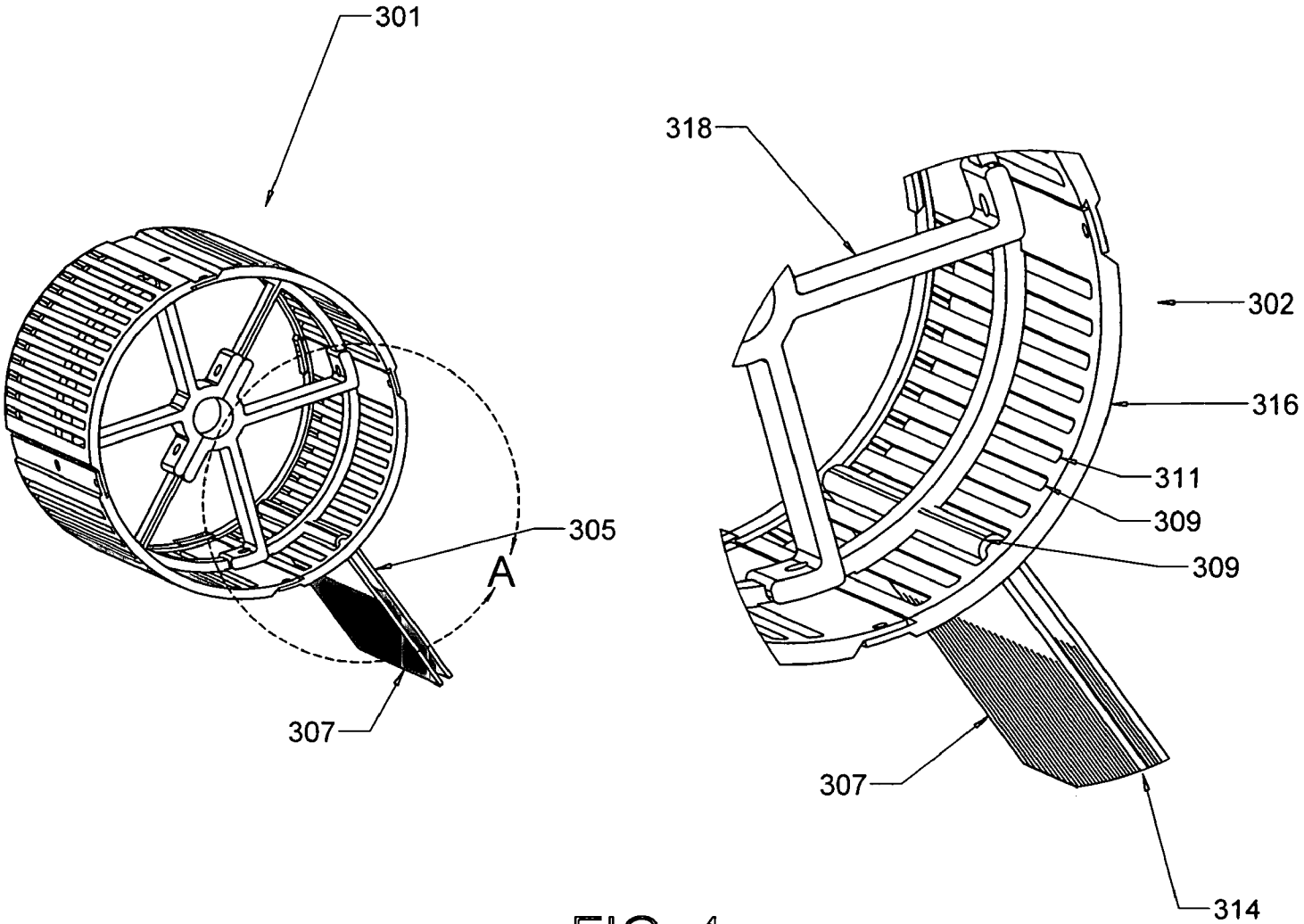
FIG. 4*c* shows a perspective view and a cutaway view of a locking/engaging system for the support body and washing vanes.

FIG. 4*c* shows a cutaway perspective and section of an assembly or end 301 for the support body 302. A single strip of vane material 305 forms two vanes 307 by looping through adjacent openings (e.g., similar to 309 and 311). This facilitates removal and replacement of vanes, as compared to the locking mechanism of FIG. 4*b*. In the section A, structural supports 318 stabilize the edge 316 of the support member 302. The ends 314 of the vanes tend to be separated by the spacing between the openings 309 and 311 in the support body 302. Vanes 312 are retained in grooves 310 by the looping of a vane strip between the grooves 309 and 311. In FIG. 4*c*, there are four plastic slotted vane holders 316 with folded in half vane 314 inserted from the inside of the support body 302. Four of these assemblies, e.g., 316 with 314, are bolted together to form a complete cylinder. Retainer 318 is fastened in the middle of the cylinder assembly and retains the vanes 314 into slotted vane holder 316 as well as providing a bore used to attach completed assembly to a shaft.

Figure 5A:
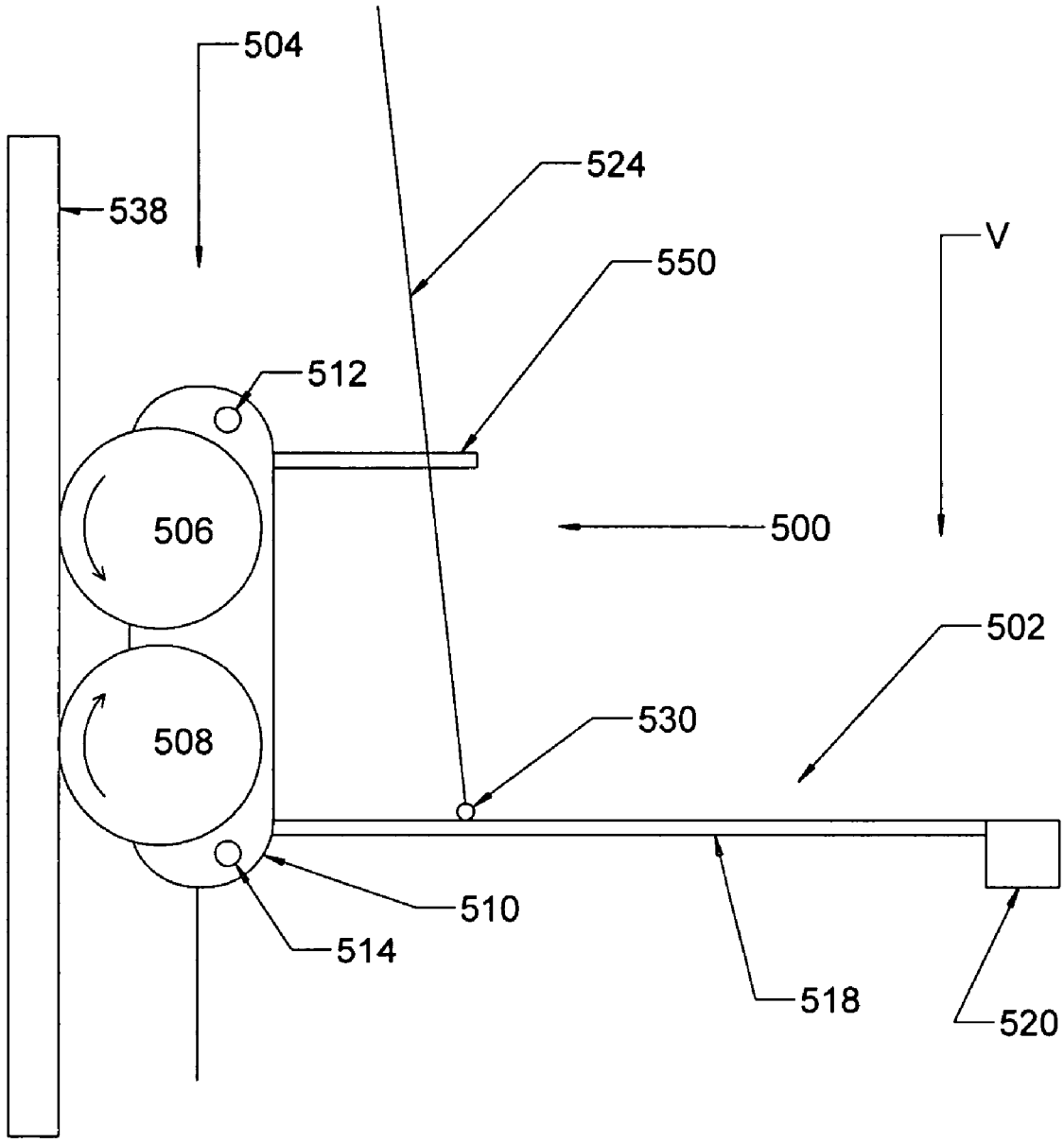
FIG. 5*a* shows a schematic figure of a counterbalancing system employed in a vertical surface cleaning system according to technology described herein.

FIG. 5*a* shows a schematic figure of a counterbalancing system 502 employed in a vertical surface cleaning system 500 according to technology described herein. The vertical surface cleaning system 502 is shown in one embodiment as follows. The cleaning unit 504 itself comprises the housing 510, two opposed rotation brushes 506, 508 and a motor 512, 514 for each of the brushes 506, 508. Attached to the housing 510 or internal frame is a pole or other rigid or semi-rigid extending member 518, weight 520, cable connector 530 attached to cable 524 which is connected to a winch (not shown) or secured point on the roof (not shown). Cable guide 550 incorporated a slot that allows cable 524 to move inward towards building surface 538 as cleaning unit 504 moves up and the angle of cable 524 increases. Cable guide 550 has a back stop to prevent the cleaning unit 504 from tipping forward. Cable guide 550 provides rotational stability to cleaning unit 504 in respect to the axis at counter balance rod 518. The cleaning system 500 is shown relative to the vertical direction V and descriptions will be made with respect to that vertical direction as a 0° angle. Although the concept of counterbalancing and the mathematics relating to fulcrums, levers and forces in rotating bodies are well understood and easily applied to structural situations, the subtleties of the systems can be quite complex. The following discussion will discuss the issues in the counterbalancing of the forces in the cleaning system 500 in simple terms, correctly assuming that extreme mathematical subtleties of the system (such as the partial or complete transfer of points of rotation or pseudo-fulcrums) are not needed for practice of the described technology, and that routine experimentation and optimization by one ordinarily skilled in the art will address those issues. The term "vertical surface" does not require that the surface be precisely vertical, but that it has a sufficient vertical component that the cleaning system can rest against the surface during cleaning. An example of a "vertical surface" that is not completely vertical would be the windowed pyramid structure of the Luxor Hotel in Las Vegas, Nev.

In the support and vertical movement of the cleaning system 500, there are many forces that operate to move or rotate the system 500. For example, as shown in FIG. 5, tension in cable 524 would tend to lift the extension 518 and rotate the cleaning system 500 about any fulcrum or pseudo-fulcrum such as the cable connector 530, The presence of a weight 520 at a position with respect to the counterbalancing side of the fulcrum, pseudo-fulcrum or point of rotation created by the cable 524 forces is used to counterbalance the weight of the cleaning unit 504. With cable 524 attached to the roof top support unit (not shown) at a point near the building edge 538 and the end attached to cable connector 530 which is extended out a distance from building wall 538, a force is generated by the increased angle on cable 524, which applies the required force for cleaning to the brush material on rotating elements 506 and 508. This force also stabilizes the cleaning system 500 against any rotational forces, particularly if there were any wind present to further destabilize the system 500. In the counterbalancing system 502 shown as a non-limiting example of how the counterbalancing forces can be designed into the system, a number of options and variations are also shown.

Figure 5B:
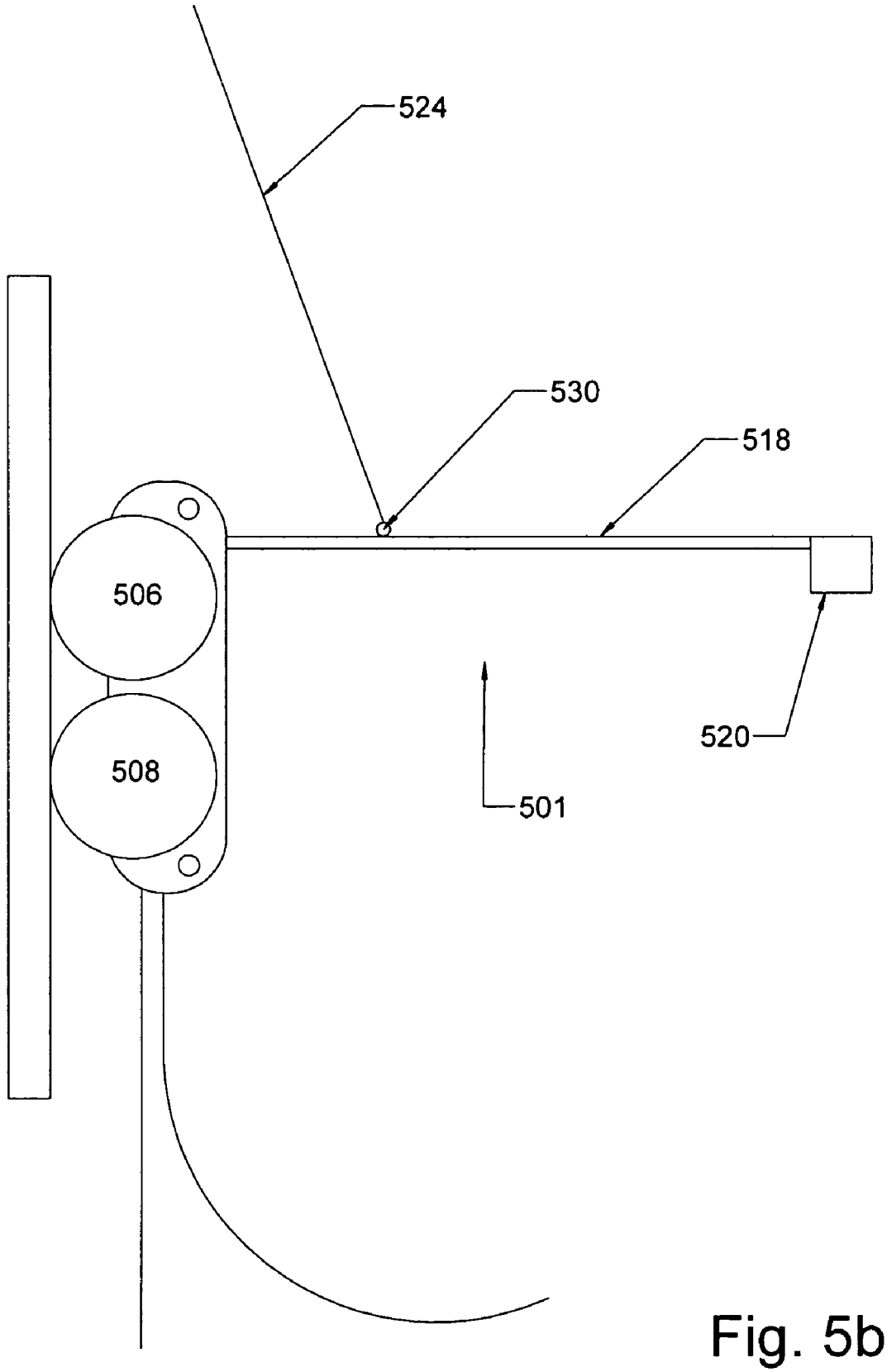
FIG. 5*b* shows a schematic figure of an alternative counterbalancing system employed in a vertical surface cleaning system according to technology described herein.
Figure 5C:
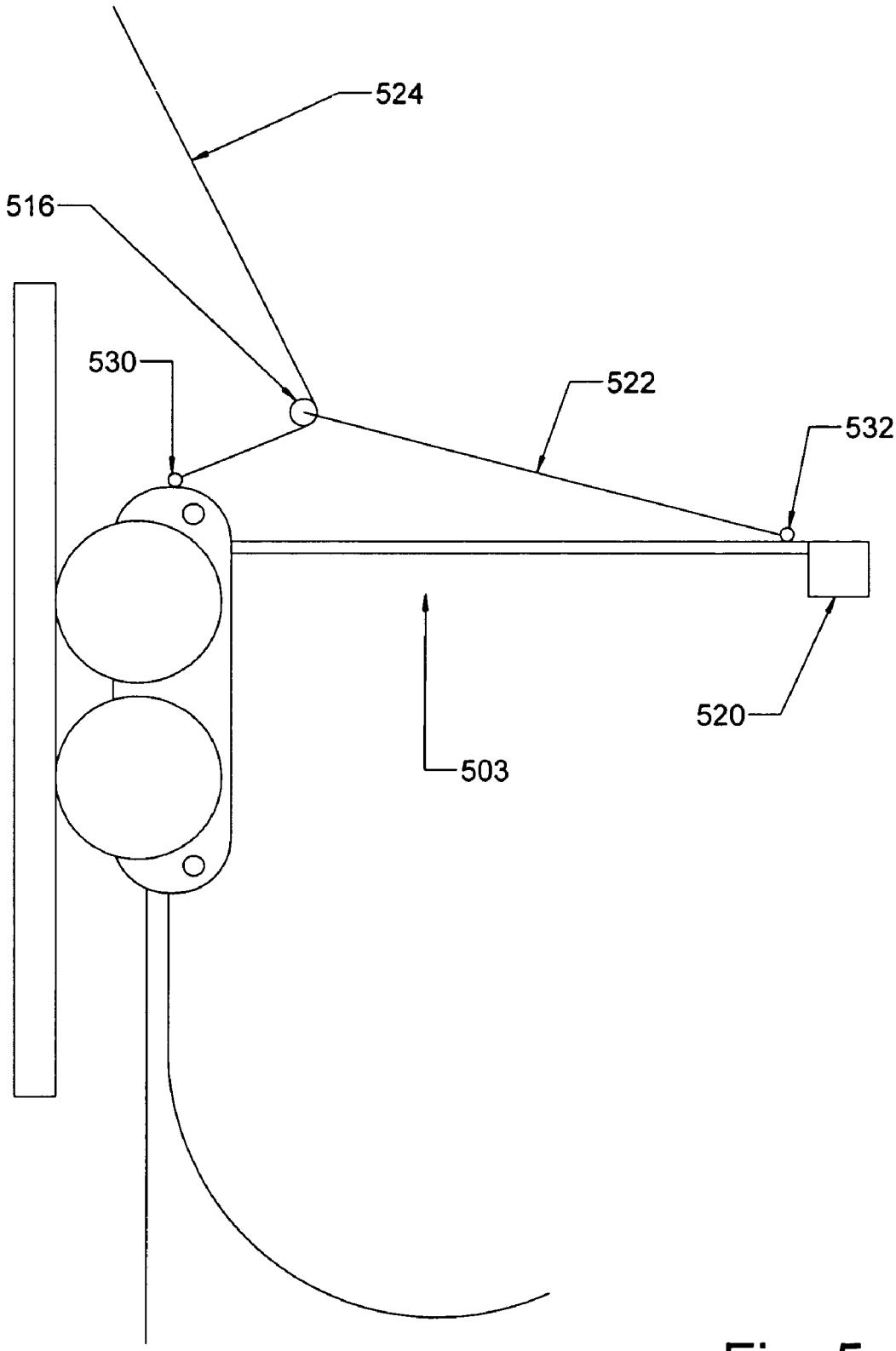
FIG. 5*c* shows a schematic figure of an alternatibe counterbalancing system employed in a vertical surface cleaning system according to technology described herein.
Figure 5D:
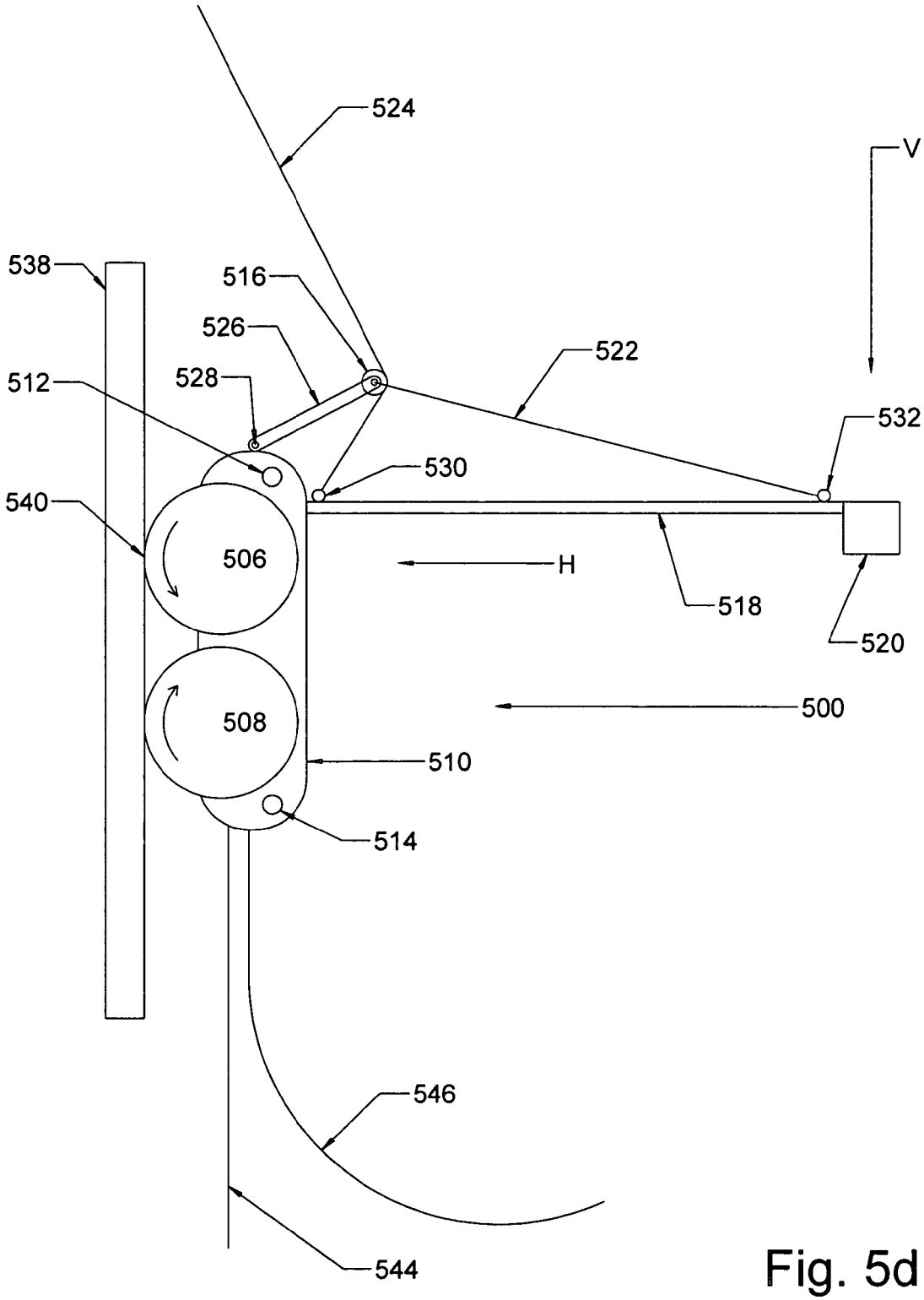
FIG. 5*d* shows a schematic figure of an alternative counterbalancing system employed in a vertical surface cleaning system according to technology described herein.

In FIG. 5*d*, the pulley 516 can also assist in providing counterbalancing rotational forces to the lifting and rotational force provided by cable 522. Even though the cable connects to the pulley, the support/raising cable 524 extends around the pulley 516 and provides a rotational force through connector 530 that balances against the rotational force of the cable 522. In combination with the forces provided by the weight 520, these forces can be adjusted so that the cleaning system is stable. For example, in FIG. 5*d*, the cable connector 532 may be adjustable to adjust the position of the fulcrum or point of rotation (particular along direction H), the connector arm 526 may pivot about the hinge or rotation connector 528, and the direction of forces provided by cable tension and weight can be adjusted. The numbering of elements in FIG. 5*d* is consistent with the numbering in FIG. 5*a*. It would be an ideal situation where opposed forces around all fulcrums, pseudo-fulcrums and points of rotation were exactly balanced to that under Newton's Second Law of Motion, there would be no rotation of the cleaning system. With an active system that is moving, being moved, having liquids carried and projected, and with motors and rotating brushes, a continuous perfect balancing of the system is not feasible. Additionally, rotation of a body can sometimes be a natural attempt of the body to stabilize itself, rotating the weights to distribute forces into an orientation of elements where the forces are balanced. Hence, when a body supported by a cable is intentionally shifted out of balance, the resulting motion and forces are an attempt to return or move the body into a balanced position. This can be envisioned in FIG. 5*d* by considering the pseudo-fulcrum as the contact point 540 between the brush 506 and the wall 538. The forces in cable 524 would tend to rotate the motor 514 and the lower part of the housing 510 counterclockwise around the pseudo-fulcrum (or point of rotation) 540, lifting the motor 514 in the housing 510 away from the wall 538. This rotation would create an additional force against the cleaning system 500 that would be clockwise from the weight of the motor 514 being shifted to a location where it leveraged against the pseudo-fulcrum 540. An optional ground stabilizing drain hose or cable 544 and an electrical power cord and/or water supply hose 546 are shown.

By proper counterbalancing within the cleaning system 500, it is possible to provide the system 500 with only a single cable 524 that supports the system, and the complexity, expense and weight of multiple support or stabilizing cables and attachment systems is not needed. It is possible to have one or two cable supports to stabilize the cleaning system, but these are no longer essential with the cleaning system. No personnel must be in direct contact with the cleaning system, that is workers are not on scaffolding or chairs or supports on the outside of the building against the exterior walls. An operator may be on the roof to assure system performance or even to manually move (horizontally) the system after a vertical section has been cleaned.

It is also possible to have a sturdy hose (providing the liquid) operate as the support cable on which a winch operates to raise and lower the cleaning system. An electrical line providing current to the motor(s) in the cleaning system on the carriage can be attached to the hose and run parallel to the hose. Additional support cables for the entire system would again not be necessary, but could be optional.

In the system shown in FIG. 5*d*, by way of a non-limiting example it can be seen that there are two motors 512 and 514 provided for the brushes 506 and 508, respectively. These motors drive the brushes in a counter-rotational direction (e.g., 506 counterclockwise and 508 clockwise, or vice versa).

FIG. 5*b* shows a schematic figure of an alternative counterbalancing system 501 employed in a vertical surface cleaning system according to technology described herein. The numbering of the elements is the same as in FIG. 5*a*, with the location and positioning of the elements differently providing different counterbalancing forces.

FIG. 5*c* shows a schematic figure of an alternative counterbalancing system 503 employed in a vertical surface cleaning system according to technology described herein. The pulley 516 is shown as free-floating, with the tension provided between cable 522 and cable 524 assisting in properly positioning forces within the system. Connector 532 may be adjustable, but should not shift after securing (unless remotely controlled) when the entire system 503 is under manual operator control (as when it is to be dropped from the roof for an initial pass).

Figure 6:
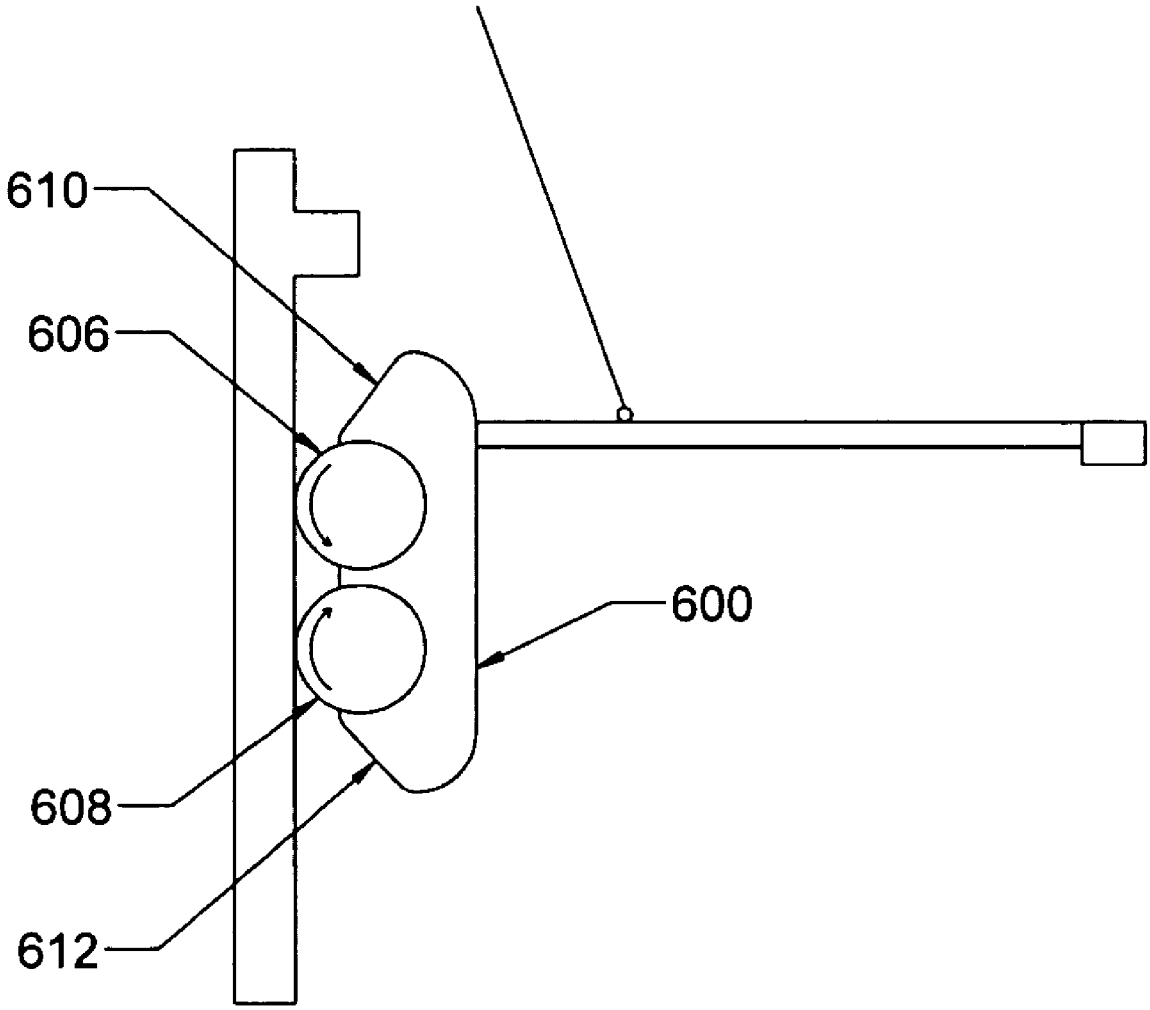
FIG. 6 shows a side view of a carriage support and traveling mechanism for use on a rooftop to carry a cleaning system.

FIG. 6 shows a schematic of other aspects of a cleaning system 600 within the generic scope of the present disclosure. The counter-rotating brushes or cleaning elements 606 and 608 are shown. Counter rotation of the brushes 606 and 608 allows for single pass cleaning as this action gets to the top and bottom of the frames regardless of the direction of travel of the cleaning unit 600. Of particular note in this figure is the shape of the edges 610 and 612 that would be adjacent the wall (not shown) and might impact any raised edges or frames on the wall. By having the edges form an acute angle with the wall, the edges 612 and 610, depending upon the direction of travel, would impact any raised elements and assist in the cleaning system 600 being able to climb over the raised element. At least one brush or cleaning element 606 and 608 would tend to remain in contact with the surface to be cleaned.

Figure 7:
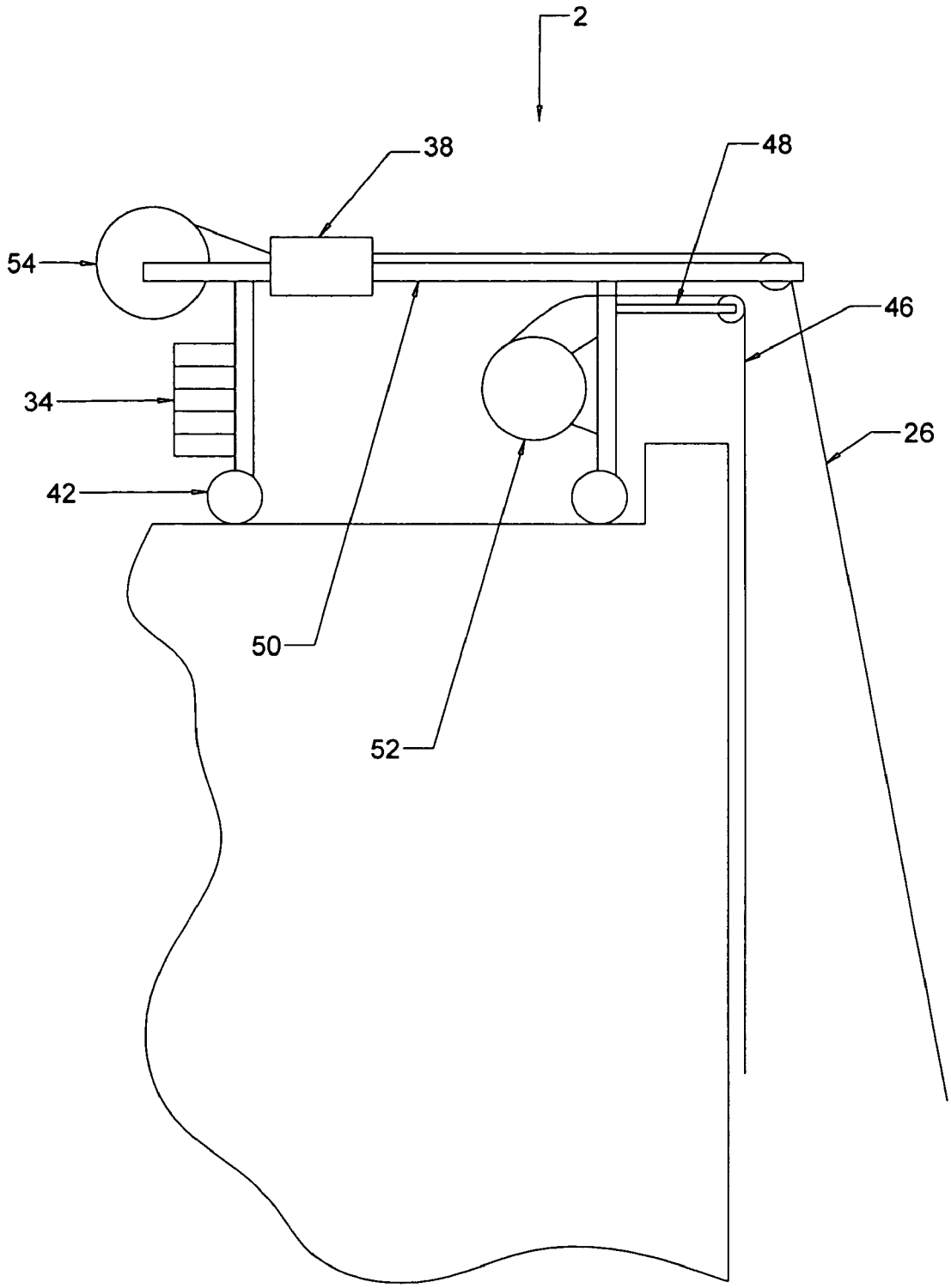
FIG. 7 shows a traveling cable and hose roof top system.

FIG. 7 shows an alternative traveling cable and hose roof top system 2. In addition to the elements shown and numbered in accordance with the numbering in FIG. 1, are shown the counterweights 34, cable 26, grip winch 38, locking position castor wheel 42, hose/electrical cord 46, the rolling rig 50, the hose reel 52, cable reeler 54 and a hose guide arm 48.

Figure 8:
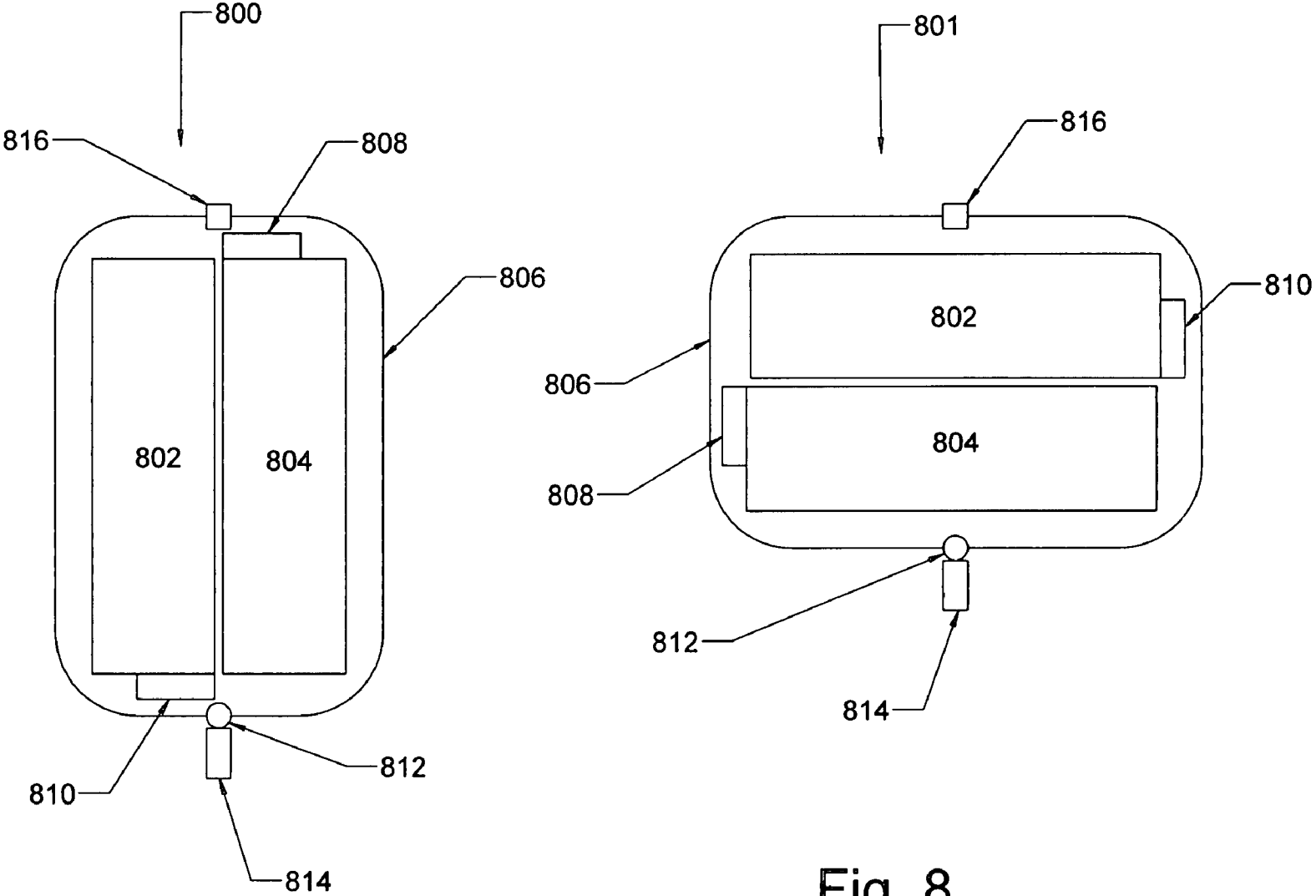
FIG. 8 shows a back view or alternative water application and brush contact systems for use with herein described technology.

FIG. 8 shows back views of alternative horizontal modes for cleaning units 800, and vertical mode cleaning units 801 and their water application and brush contact systems for use with herein described technology. Horizontal mode cleaning unit 800 shows one optional configuration for a unit for use when cleaning in a horizontal mode. The unit starts at the top and moves across the entire wall, then drops down 1 length of the brushes and travels back, and then repeats the sequence. Cleaning unit 801 shows an optional configuration for the unit for particular use in a vertical cleaning mode. Within FIG. 8, 802 and 804 show the brushes, 806 is the housing, 808 is the drive motor for brush 804, 810 the drive motor for brush 802, 812 a counter balance weight support tube, 814 a counter balance weight, and 816 an upper cable guide.

The use of liquids and other additives to the system and the effects of their use are shown in the accompanying Table 1.

TABLE 1

| | Typical Public Water Supply | Conditioned Wash Water | Disposal Wash Water |
|---|---|---|---|
| pH | 8.1 | 6.5 | 6.4 |
| Hardness (PPM $CaCO_3$) | 180 | <0.02 | 22 |
| Calcium (PPM $CaCO_3$) | 140 | <0.02 | 18 |
| Magnesium (PPM $CaCO_3$) | 40 | <0.01 | 4 |

TABLE 1-continued

| | Typical Public Water Supply | Conditioned Wash Water | Disposal Wash Water |
|---|---|---|---|
| Alkalinity (PPM CaCO.sub.3) | 125 | <0.01 | 32 |
| Chlorides (PPM Cl) | 24 | <0.01 | 5 |
| Sulfates (PPM $SO_4$) | 8 | <0.01 | 41 |
| Total Solids (PPM) | 450 | <0.3 | 250 |
| Dissolved Solids (PPM) | 445 | 0.0 | 80 |
| Suspended Solids (PPM) | 5 | 0.0 | 170 |
| Conductivity (Micromhos) | 480 | 0.6 | 125 |

What is claimed:

1. An automated cleaning device for cleaning a generally vertically extending exterior surface of a building comprising:

a housing, the housing sized and shaped to permit cleaning of the generally vertically extending exterior surface of a building while minimizing liquid splashing away from the building during a cleaning operation;

at least one cleaning element disposed in the housing and configured to rotate about a generally horizontal axis, the cleaning element having a horizontal length greater than its height;

said cleaning element including a plurality of outwardly extending cleaning vanes extending at least partially beyond the housing and configured to contact the generally vertically extending exterior surface of the building when the cleaning element is rotated;

a first motor disposed on the housing operable to rotate the cleaning element;

a cleaning liquid supply system provided to the housing, including a plurality of applicators, the plurality of applicators located and configured to spray cleaning liquid onto the generally vertically extending exterior surface during the cleaning operation;

a second motor disposed on the housing operable to control vertical movement of the housing relative to the generally vertically extending exterior surface of the building during cleaning of the surface; and a counterforce system disposed on the housing, the counterforce system configured to provide a substantially perpendicular continuous force on the housing and cleaning element towards the generally vertically extending exterior surface of the building without the use of restraining cables to maintain the cleaning vanes in continuous contact with the generally vertically extending exterior surface of the building during the cleaning operation.

2. The automated cleaning device of claim 1 including:

a first cleaning element and a second cleaning element located generally parallel to the first cleaning element;

supports rotatably mounting the first and second cleaning elements on the housing in positions whereby the first and second cleaning elements are operable to contact and clean said generally vertically extending exterior surface of the building; and separate motors operatively connected to the first and second cleaning elements for rotating the first and second cleaning elements in opposite rotational directions.

3. The automated cleaning device of claim 1 wherein:
the counterforce system comprises a counterbalance assembly.

4. The automated cleaning device of claim 3 wherein:
the counterbalance assembly comprises a pole extending generally horizontally outwardly from the housing and a weight disposed at the end of the pole.

5. The automated cleaning device of claim 1 wherein:
the cleaning liquid supply system provides deionized water for cleaning contaminants from the generally vertically extending exterior surface.

6. An automated cleaning system for cleaning a generally vertically extending exterior surface of a building comprising:
a cleaning unit suspended over the side of the building;
the cleaning unit including a housing, the housing sized and shaped to permit cleaning of the generally vertically extending exterior surface while minimizing liquid splashing outward from the building during cleaning operation;
at least one cleaning element disposed in the housing and configured to rotate about a generally horizontal axis, the cleaning element having a horizontal length greater than its vertical height;
said cleaning element having a plurality of outwardly extending cleaning vanes operable to contact the generally vertical extending exterior surface of the building during the cleaning operation;
a drive motor operable to rotate the cleaning element;
a motor disposed on the housing operable to control movement of the cleaning unit in a vertical direction during a cleaning operation;
a counterforce system disposed on the housing, the counterforce system configured to provide a substantially perpendicular continuous force on the housing and cleaning element towards the generally vertically extending exterior surface without the use of restraining cables to maintain the cleaning vanes in contact with the generally vertically extending exterior surface of the building during the cleaning operation;
a rooftop suspending element configured to suspend the cleaning unit from the top of the building; and
a cable connecting the rooftop suspending element to the cleaning unit.

7. The automated cleaning system of claim 6 wherein:
the counterforce system of the cleaning unit comprise a counterbalance assembly.

8. The automated cleaning system of claim 7 wherein:
the counterbalance assembly comprises a pole extending generally horizontally outwardly from the housing with a weight disposed at the end of the pole.

9. The automated cleaning system of claim 6 wherein:
the cleaning unit further comprises a cleaning liquid supply system comprising a plurality of applicators located and configured to spray cleaning liquid onto the generally vertically extending exterior surface during cleaning operation.

10. The automated cleaning system of claim 9 wherein:
the cleaning liquid supply system provides deionized water for cleaning contaminants from the generally vertically extending exterior surface.

11. The automated cleaning system of claim 6 including:
a first cleaning element and a second cleaning element located generally parallel to the first cleaning element;
supports rotatably mounting the first and second cleaning elements on the housing in positions whereby the first and second cleaning elements are operable to contact and clean said generally vertically extending exterior surface of the building; and
separate motors operatively connected to the first and second cleaning elements for rotating the first and second cleaning elements in opposite rotational directions.

12. An automated cleaning device for cleaning a generally vertically extending surface comprising:
a carriage;
at least one generally cylindrical cleaning element disposed on the carriage and configured to rotate about a generally horizontal axis;
a drive motor operable to rotate the cleaning element;
a motor disposed on the carriage operable to control movement of the automated cleaning device in a generally vertical direction relative to the generally vertically extending surface during a cleaning operation;
at least one applicator located and configured to spray a cleaning liquid onto the generally vertically extending surface during the cleaning operation; and
a counterforce system disposed on the carriage, the counterforce system configured to provide a substantially horizontal perpendicular continuous force on the carriage and cleaning element towards the generally vertically extending surface without the use of restraining cables to maintain the cleaning element in contact with the generally vertically extending surface during the cleaning operation.

13. The automated cleaning device of claim 12 wherein:
the cleaning liquid is deionized water for cleaning contaminants from the generally vertically extending surface.

14. The automated cleaning device of claim 12 wherein:
the counterforce system comprises a counterbalance assembly.

15. The automated cleaning device of claim 14 wherein:
the counterbalance assembly comprises a pole extending generally horizontally outwardly from the housing with a weight disposed at the end of the pole.

16. The automated cleaning device of claim 12 including:
a first cleaning element and a second cleaning element located generally parallel to the first cleaning element;
supports rotatably mounting the first and second cleaning elements on the housing in positions whereby the first and second cleaning elements are operable to contact and clean said generally vertically extending surface; and
separate motors operatively connected to the first and second cleaning elements for rotating the first and second cleaning elements in opposite rotational directions.

17. An apparatus for cleaning an upright surface of a structure comprising:
a carriage;
at least on cleaning element rotatably mounted on the carriage operable to contact and clean the upright surface of the structure;
supports rotatably mounting the cleaning element on the carriage for rotation about a generally horizontal axis;
a first motor operably connected to the cleaning element to rotate the cleaning element;
at least one liquid applicator mounted on the carriage above the cleaning element operable to dispense a liquid toward the upright surface of the structure;
a support mountable on the structure having the upright surface above the carriage;
said support including an elongated flexible member extended downwardly adjacent the upright surface, a second motor mounted on the carriage operably connected to the flexible member to control vertical movement of the carriage, cleaning element and liquid applicator relative to said upright surface of the structure thereby cleaning said upright surface of the structure; and counterforce apparatus mounted on the carriage operable to provide a substantially horizontal continuous force on the carriage and cleaning element perpendicular to the upright surface to maintain the cleaning element in cleaning engagement with said surface of the structure during the vertical movement of the cleaning element relative to said surface of the structure.

18. The apparatus of claim 17 including:

said counterforce apparatus including rigid member, at least one weight mounted on the rigid member outwardly of the cleaning element to counterbalance the carriage and cleaning element and retain the cleaning element in continuous operative engagement with the upright surface of the structure.

19. The apparatus of claim 17 wherein:

the cleaning element comprises a roller having outwardly extended flexible foam strips.

20. The apparatus of claim 17 including:

a first cleaning element;

a second cleaning element;

supports rotatably mounting the first and second cleaning elements on the carriage operable to contact and clean the upright surface of the structure; and separate motors operatively connected to the first and second cleaning elements for rotating the first and second cleaning elements in opposite rotational directions.

21. The apparatus of claim 17 including:

a first cleaning element and a second cleaning element located generally parallel to the first cleaning element;

supports rotatably mounting the first and second cleaning elements on the housing in positions whereby the first and second cleaning elements are operable to contact and clean said generally vertically extending exterior surface of the structure; and separate motors operatively connected to the first and second cleaning elements for rotating the first and second cleaning elements in opposite rotational directions.

* * * * *